US006346043B1

(12) United States Patent
Colin et al.

(10) Patent No.: US 6,346,043 B1
(45) Date of Patent: Feb. 12, 2002

(54) IMAGE MATCHING GAME METHOD AND APPARATUS

(75) Inventors: Brian F. Colin, Homewood; Jeffry L. Nauman, Hinckley, both of IL (US)

(73) Assignee: International Game Technology, Reno, NV (US)

( * ) Notice: Subject to any disclaimer, the term of this patent is extended or adjusted under 35 U.S.C. 154(b) by 0 days.

(21) Appl. No.: 09/395,034

(22) Filed: Sep. 13, 1999

(51) Int. Cl.[7] ..... A63F 9/22

(52) U.S. Cl. ..... 463/17; 463/18; 463/19; 463/20; 463/16; 463/9; 273/273

(58) Field of Search ..... 463/16–20, 9; 273/273

(56) References Cited

U.S. PATENT DOCUMENTS

| | | | | |
|---|---|---|---|---|
| 5,401,024 A | * | 3/1995 | Simunek | 273/138 A |
| 5,411,271 A | * | 5/1995 | Mirando | 273/434 |
| 5,743,800 A | | 4/1998 | Huard et al. | 463/26 |
| 5,791,991 A | | 8/1998 | Small | 463/41 |
| 5,833,537 A | * | 11/1998 | Barrie | 463/21 |
| 5,855,514 A | * | 1/1999 | Kamille | 463/17 |
| 5,876,284 A | | 3/1999 | Acres et al. | 463/25 |
| 5,882,260 A | * | 3/1999 | Marks et al. | 463/13 |
| 5,947,820 A | | 9/1999 | Morro et al. | 463/9 |
| 6,015,346 A | * | 1/2000 | Bennett | 463/20 |
| 6,048,268 A | | 4/2000 | Humble | 463/17 |
| 6,089,976 A | | 7/2000 | Schneider et al. | 463/16 |

FOREIGN PATENT DOCUMENTS

| | | | |
|---|---|---|---|
| WO | WO 98/09258 | 3/1998 | G07F/17/34 |
| WO | WO 98/09259 | 3/1998 | G07F/17/34 |
| WO | WO 99/19037 | 4/1999 | A63F/9/22 |

OTHER PUBLICATIONS

U.S. Ser. No. 09/605,023 filed Jun. 28, 2000 and entitled "Gaming Device With Bonus Scheme Providing Increased Reward For Selecting Related Symbols."

Jackpot Party Video™ brochure; Williams Gaming Inc., www.wmsgaming.com; copyright 1999, 2 pages.

DreamWeaver™ brochure: Aristocrat Liesure Industries Pty Ltd., copyright 1997 and Feb. 1998, 2 pages.

* cited by examiner

*Primary Examiner*—Valencia Martin-Wallace
*Assistant Examiner*—Carmen D. White
(74) *Attorney, Agent, or Firm*—Marshall, Gerstein, & Borun

(57) ABSTRACT

An image matching gaming method suitable for use as bonus game on a slot machine is provided. The method includes allowing the player to have an active role in selecting the bonus award. The player is allowed to see all the awards associated with possible selection after his choices have been made.

16 Claims, 11 Drawing Sheets

| | | | | | | | | | | |
|---|---|---|---|---|---|---|---|---|---|---|
| ACE | 35 | 37 | 55 | 50 | 46 | 44 | 42 | 41 | 40 | 48 |
| KING | 28 | 37 | 40 | 44 | 35 | 39 | 32 | 33 | 36 | 33 |
| QUEEN | 25 | 33 | 28 | 30 | 20 | 19 | 26 | 24 | 17 | 22 |
| JACK | 22 | 7 | 19 | 13 | 17 | 15 | 11 | 14 | 10 | 9 |

Fig. 10

IMAGE MATCHING GAME METHOD AND APPARATUS

CROSS-REFERENCE

Cross-reference is made to a provisional application filed in the Patent Office on Sep. 13, 1999 and assigned Ser. No. 60/153,746 and to a non-provisional application filed in the Patent Office on May 4, 2000, entitled "Gaming Bonus Apparatus and Method With Player Interaction and assigned U.S. Ser. No. 09/564,493.

FIELD OF THE INVENTION

The present invention concerns a method of gaming especially suited for use as a bonus game on gambling devices such as slot machines.

BACKGROUND AND SUMMARY OF THE INVENTION

It is presently known to include various types of bonus apparatus and award multipliers in gaming machines including slot machines. Typically, the bonus apparatus and award multipliers operate automatically with little or no player involvement in selecting the bonus award or the award multiplier. Although these passive systems have achieved popularity and success, it is believed that a more active system in which the player is involved in selecting the bonus award and award multiplier would be preferred by at least some players. It is thought that players could be left with a higher level of satisfaction with the outcome if they have an active role in its selection.

Additionally, an active system that allows the player to see what bonus award and multiplier might have been achieved if the player had made choices different than those the player made may encourage some players and make the game more fun. Therefore, unlike some bonus systems, the present invention allows the player to see the other possible bonus awards and multipliers after the player has made his selection.

An object of the present invention is to provide a method of gaming wherein the player plays an active role in selecting the award.

Another object of the present invention is to provide a method of gaming wherein, after a player plays the game and the outcome is determined, the player is able to see what the outcome would have been had the player made other selections.

Other objects and advantages of the present invention will become apparent as the description proceeds.

In accordance with the present invention, a method of gaming is provided in which a display is divided into player-selectable areas. An image and an award are randomly assigned to each of the player-selectable areas. The player selects from the player-selectable areas until a predetermined number of matching images have been selected by the player. The image and the award which were assigned to the area are displayed in each of the areas selected by the player. The player is provided with the sum of the awards associated with the predetermined number of matching images selected by the player. The images and awards which were assigned to the areas not selected by the player are displayed.

In the illustrative embodiment, the number of distinct images is at least three. In the presently preferred embodiment, the number of distinct images is five.

In the illustrative embodiment, the display is divided into twenty-four, player selectable areas. In the preferred embodiment, the display of player-selectable areas is rectangular with four rows and six columns.

In the illustrative embodiment, one or more of the images is associated with a bonus multiplier. In the preferred embodiment, the multiplier doubles the award associated with the matching images selected by the player.

In the illustrative embodiment, the number of matching images which must be selected by the player to obtain the award associated with the images in three. When three matching images are selected, the player is provided with the sum of the awards associated with the matching images and, if an image associated with a multiplier was selected, the award is multiplied by the appropriate multiplication factor.

In the illustrative embodiment, the images are playing cards. However, they can be selected in keeping with the theme of the game to be dice or pictures or likenesses of persons, animals or things.

A more detailed explanation of the invention is provided in the following drawings and claims and is illustrated in the accompanying drawings.

BRIEF DESCRIPTION OF THE DRAWINGS

FIG. 10 is a table of images and awards from an illustrative embodiment of the invention.

DETAILED DESCRIPTION OF VARIOUS EMBODIMENTS

Figure 11:
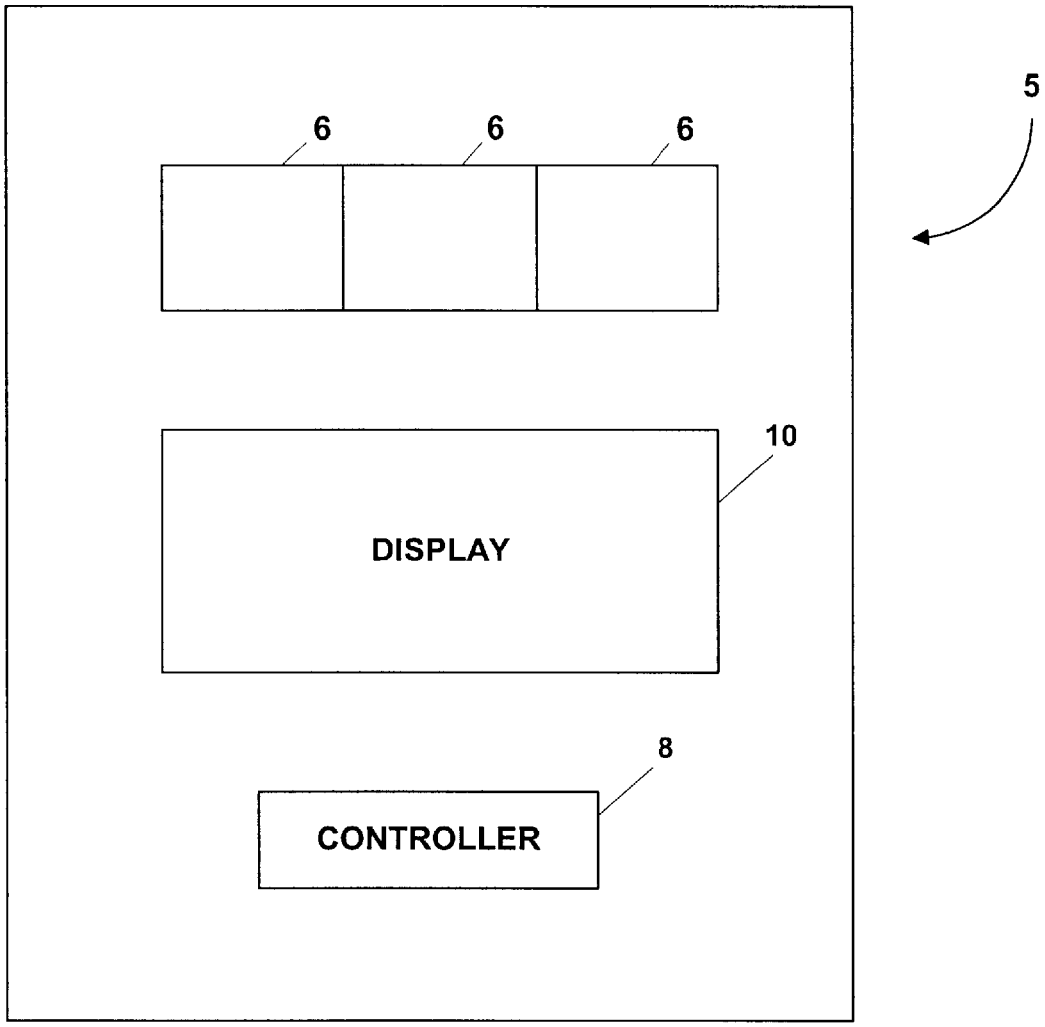
FIG. 11 illustrates an embodiment of an apparatus in accordance with the invention.

The present invention is well-suited for use as a stand-alone gaming machine. As such, it is believed that the game would be attractive and fun to play. However, the presently preferred embodiment of the invention would be as a bonus award mechanism for a gaming machine such as a slot machine 5 (FIG. 11). In such an embodiment, the opportunity to play the game of the present invention would be a reward given to players when one or more preselected results are obtained on the gaming machine. For example, if the gaming machine were a slot machine 5 with reels 6, the opportunity to play the game of the present invention as a bonus game could be a reward given when three "BONUS" symbols are displayed in a line on the reels 6. It should, therefore, be understood that the game of the present invention could be advantageously used as part of more extensive game including additional steps not described here.

It is also presently preferred that the present invention would be embodied in a computer-controlled gaming machine with a display divided into player-selectable areas. The display could be a mechanical or electromechanical display in which physical objects are moved or buttons are operated by the player. Preferably, however, the display would be a some form of television or computer monitor display such as a CRT (cathode ray tube), LCD (liquid crystal display), etc. Most preferably, the display would have a touch sensitive screen such that the player could make his selections by touching an area of the screen.

Figure 1:
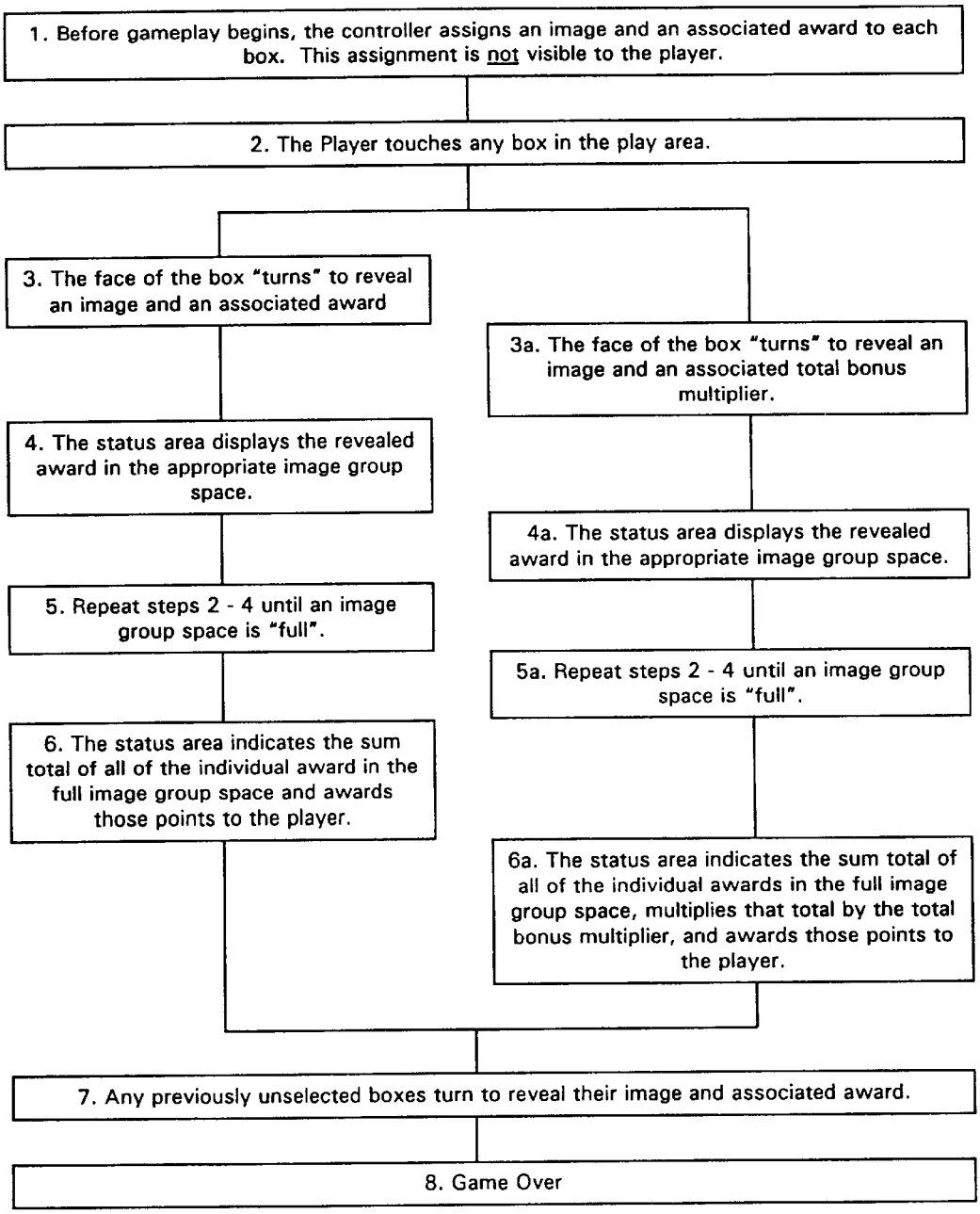
FIG. 1 is a flow diagram describing operation of an illustrative embodiment of the invention.
Figure 2:
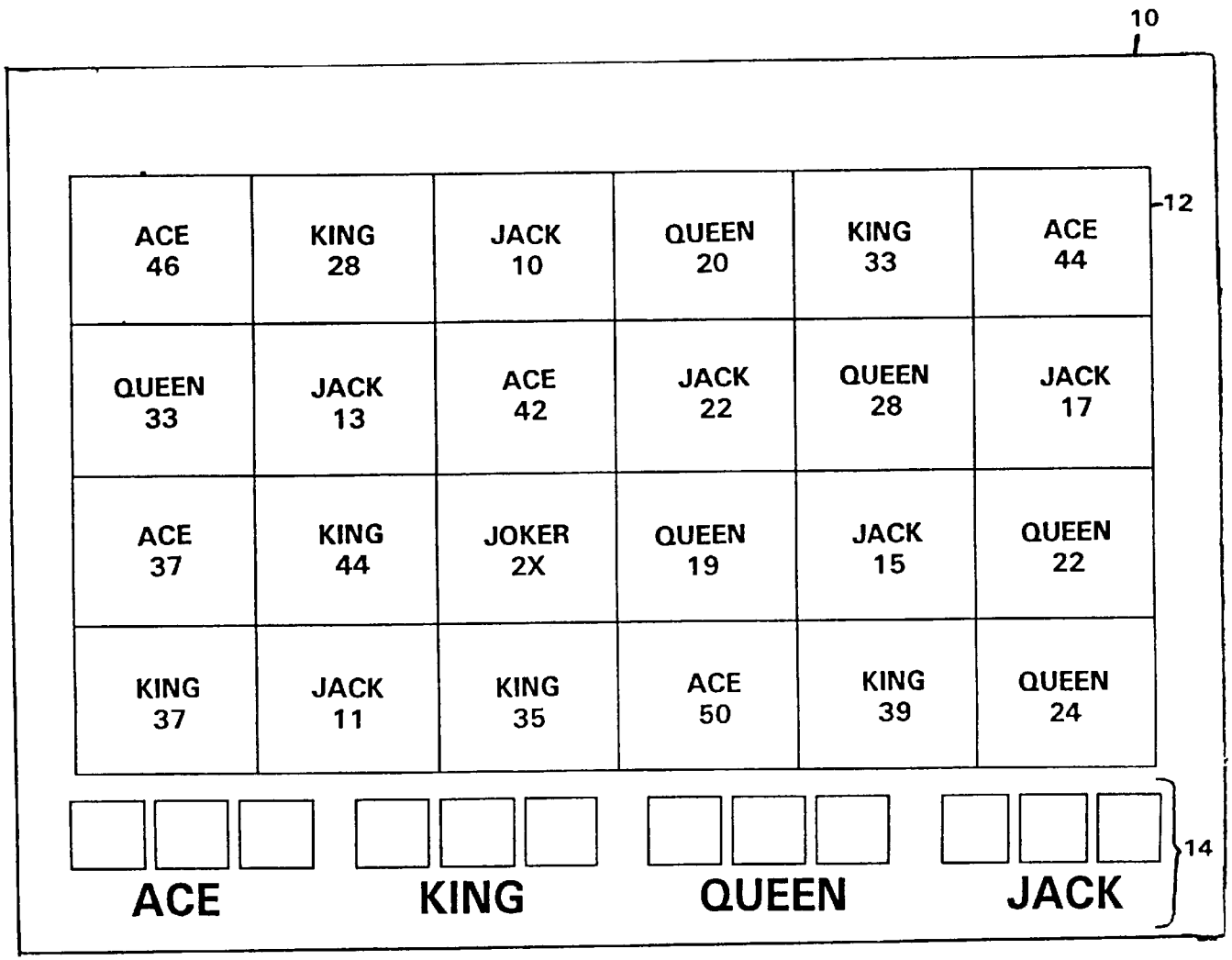
FIG. 2–9 depict the display of an illustrative embodiment of the invention during various stages of game play.

Referring to FIG. 1, a flow diagram depicting numbered steps of the image matching gaming method of the present invention is provided. In step 1, the controller 8 (FIG. 11), a microprocessor or central processing unit, assigns an image and an associated award to each box or player-selectable area. This assignment of images and awards is done in a random way. Although an example of such an assignment is illustrated in FIG. 2, the assignment of the images and awards is not disclosed to the player.

In the illustrative embodiment (see FIGS. 2–9), the images are represented by the words, "ACE", "KING", "QUEEN", "JACK" and "JOKER". Although in this embodiment the images are words, it is presently preferred that the images be pictures or likenesses of characters or scenes associated with the theme of the game. For example, if the theme of the game were based on a television program, the images could be pictures of characters or scenes from the television program. Of course, other images such as the faces of cards or dice, cartoon characters or any other graphic characters could be used as images.

Similarly, in the illustrative embodiment (see FIGS. 2–9), the awards are represented by numbers below the images. However, the award symbols could be pictures or likenesses of coins, bills or prizes selected in keeping with the theme of the game. As shown in FIG. 2, at row 3, column 3, the "JOKER" has associated with it a bonus multiplier indicated by the award symbol "2×". This award symbol indicates that whatever award is earned in the image matching game will be doubled. Of course, the multiplier could be any other factor.

In the illustrative embodiment shown in FIGS. 2–9, the game display 10 includes a rectangular-shaped play area 12 with twenty-four boxes arranged in four rows and six columns. The game display 10 also includes a status area 14. In the illustrative embodiment, the status area 14 is positioned below the play area 12 in the game display 10 and provides an indication of the play results.

Figure 3:
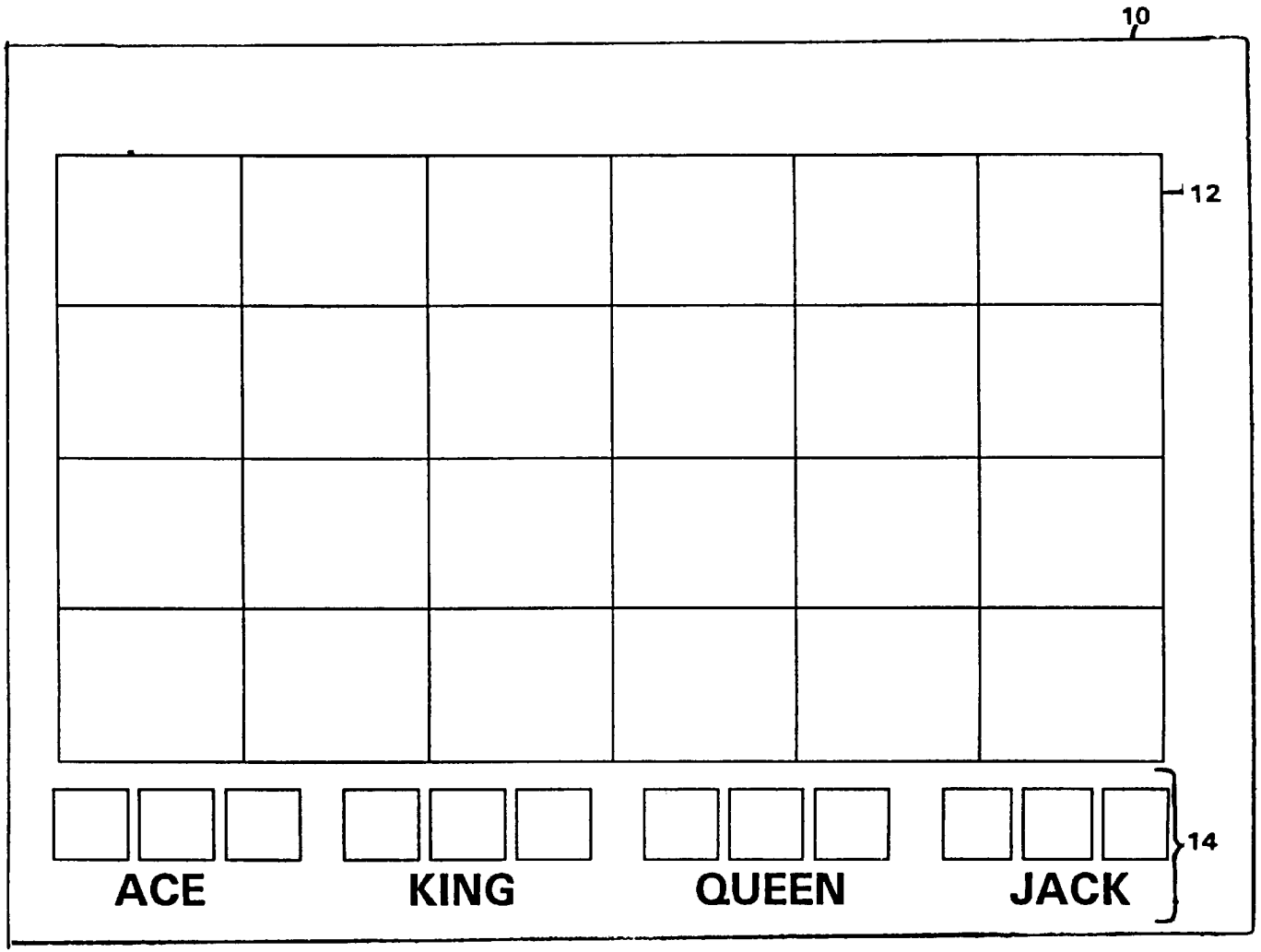

After the controller assigns the images and awards, the player is presented with a blank grid in the play area 12 as shown in FIG. 3. Each of the twenty-four boxes in the grid of the play area 12 represents a player-selectable area.

Figure 4:
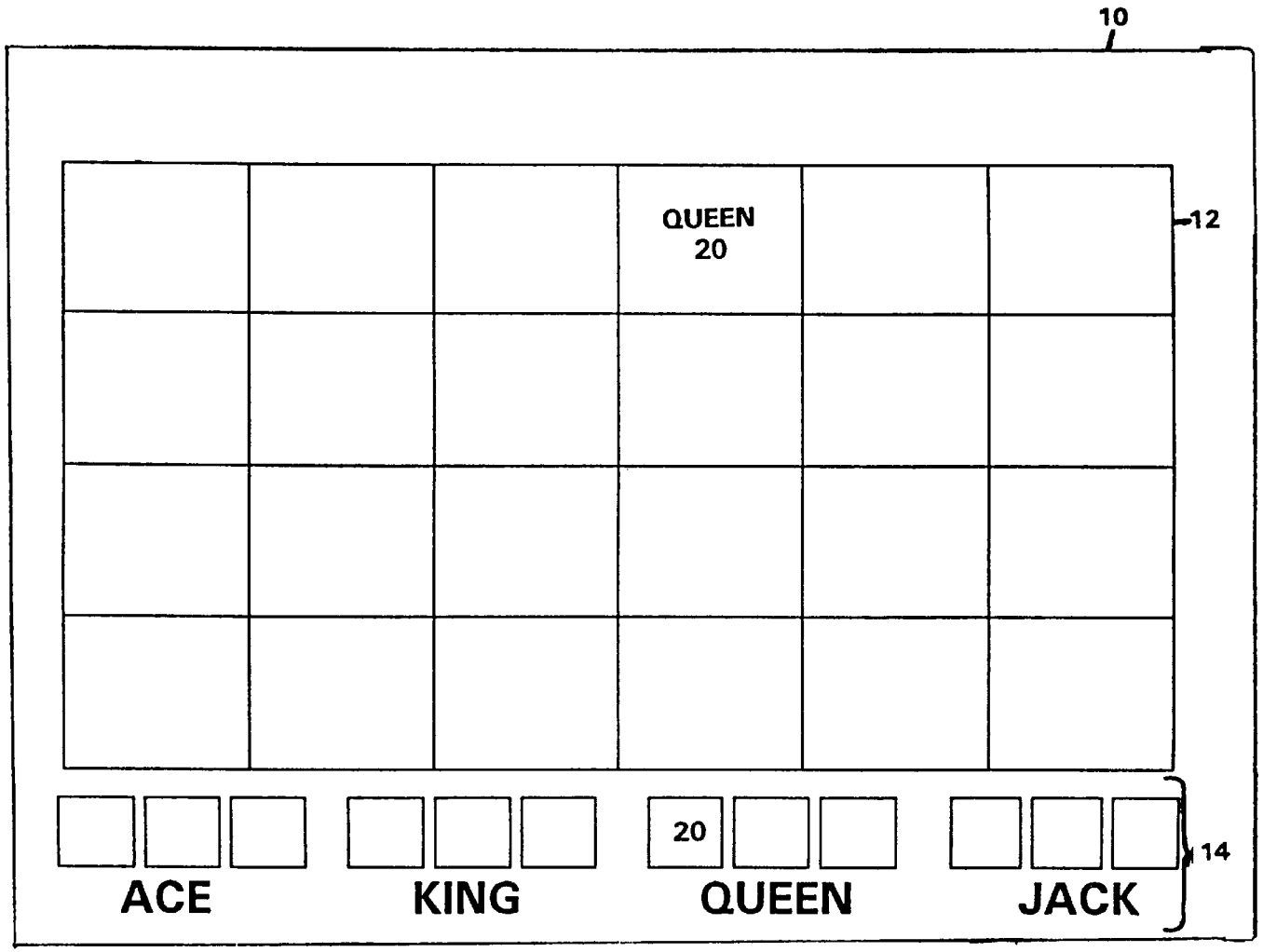

As set forth in step 2 of FIG. 1, the player selects any box in the play area 12. In the preferred embodiments, this selection would be made by touching the selected box on the touch-sensitive display. For example, if the player selects the player-selectable area or box at row 1, column 4 of the play area by touching the screen within this area, the image and award previously assigned to this area will be displayed within the box as shown in FIG. 4 and described in step 3 of FIG. 1. And, the award associated with the image in this area is displayed in the first box of the appropriate image group of the display area 14.

Figure 5:
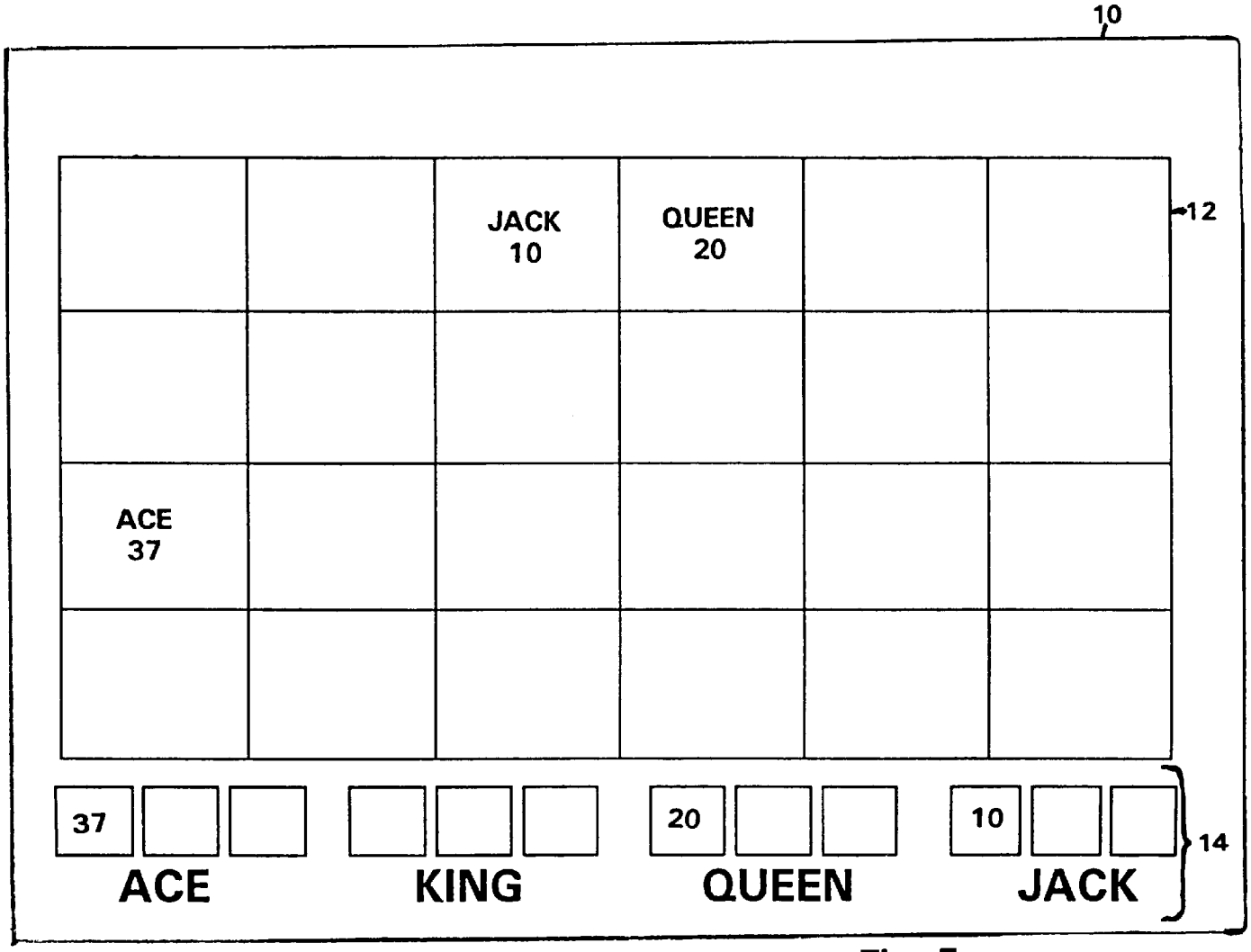
Figure 6:
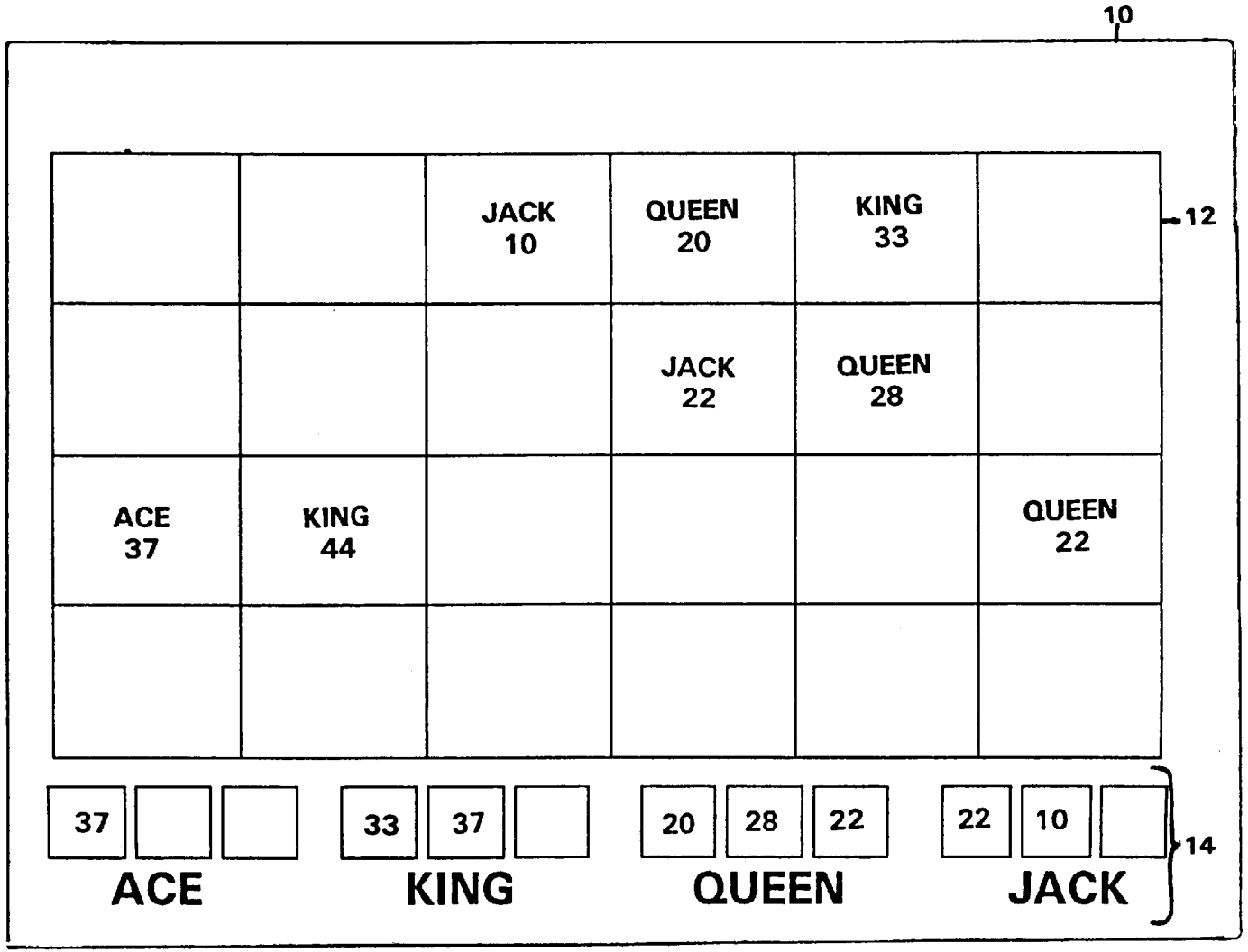

As set forth in step 4 of FIG. 1, the game continues by the player selecting additional boxes (see FIG. 5) until three matching images are selected (see FIG. 6). As shown in FIGS. 4–6, the player's selections are indicated as they are made by the images and award for each box selected by the player being shown in the play area 12 and by the awards being accumulated in the appropriate image group of the status area 14.

When three matching images are selected, the boxes containing them are highlighted in the preferred embodiments. The status area 14 of the game display 10 indicates the award total which is the sum of the awards for the three matching images and that award is provided to the player as described in step 6 of FIG. 1. In the illustrative embodiment of FIGS. 4–6, the award provided to the player would be 70 which is calculated by taking the sum of the awards associate with the "QUEEN" images (20+28+22=70).

Figure 7:
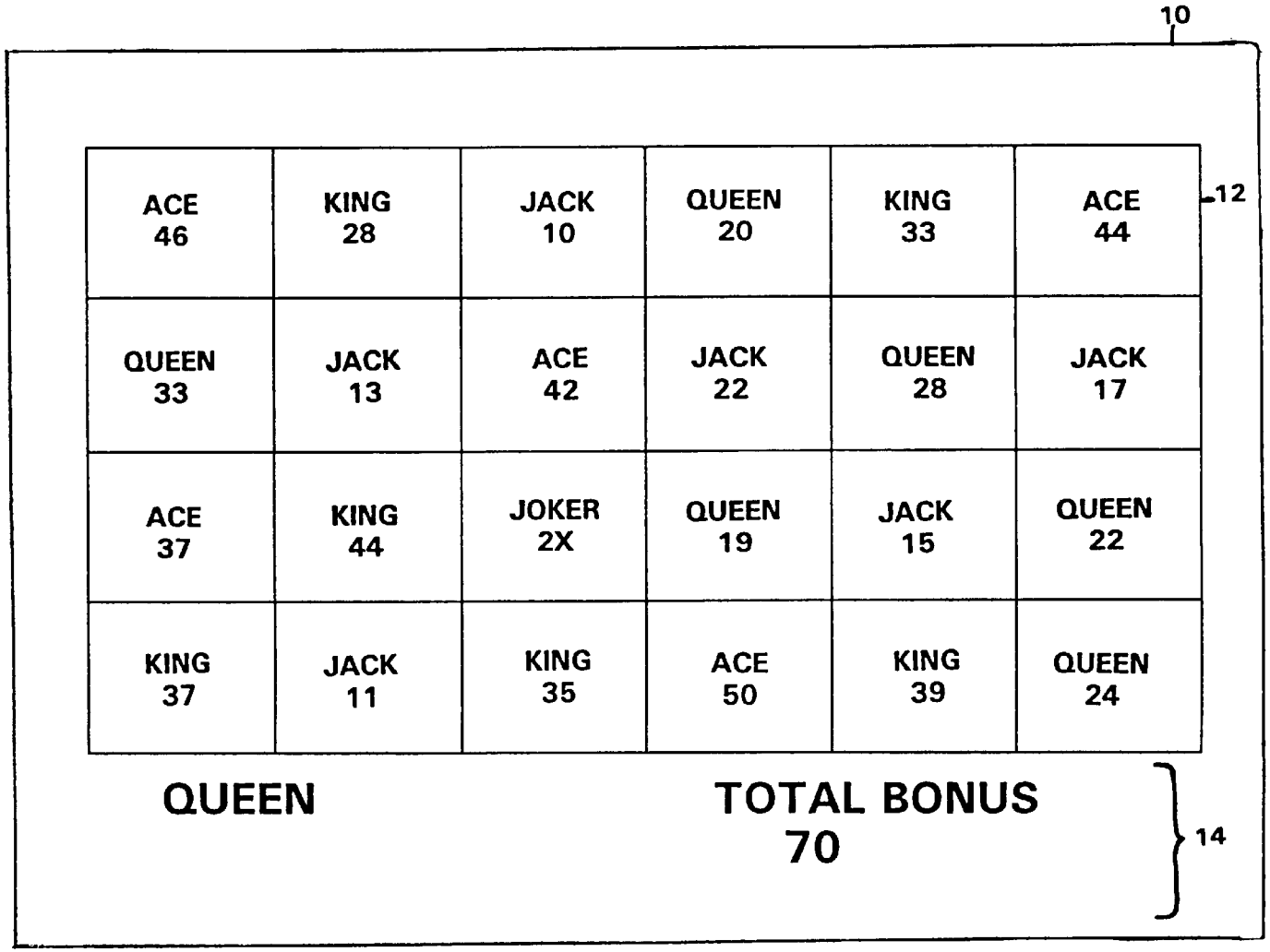

As shown in FIG. 7 and described in step 7 of FIG. 1, the images and awards assigned to any unselected boxes are revealed. This feature allows the player to see what would have happened if he had made choices other than those he made. It is believed this feature will make the game more fun to play and encourage continued play. It is also believed that this feature will reduce the dissatisfaction or negative feelings which could be generated by a game where the player has no active role in determining the outcome.

Figure 8:
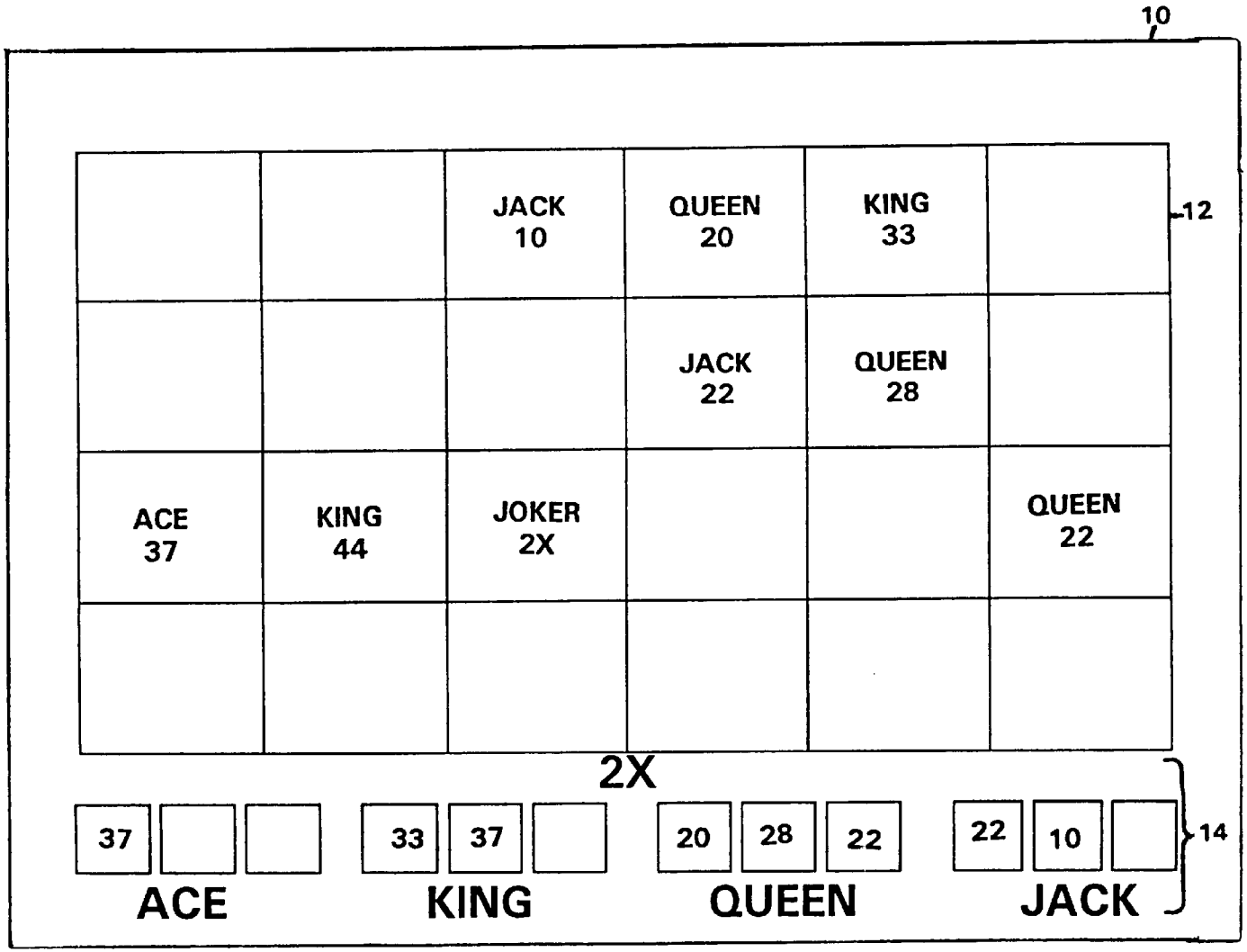
Figure 9:
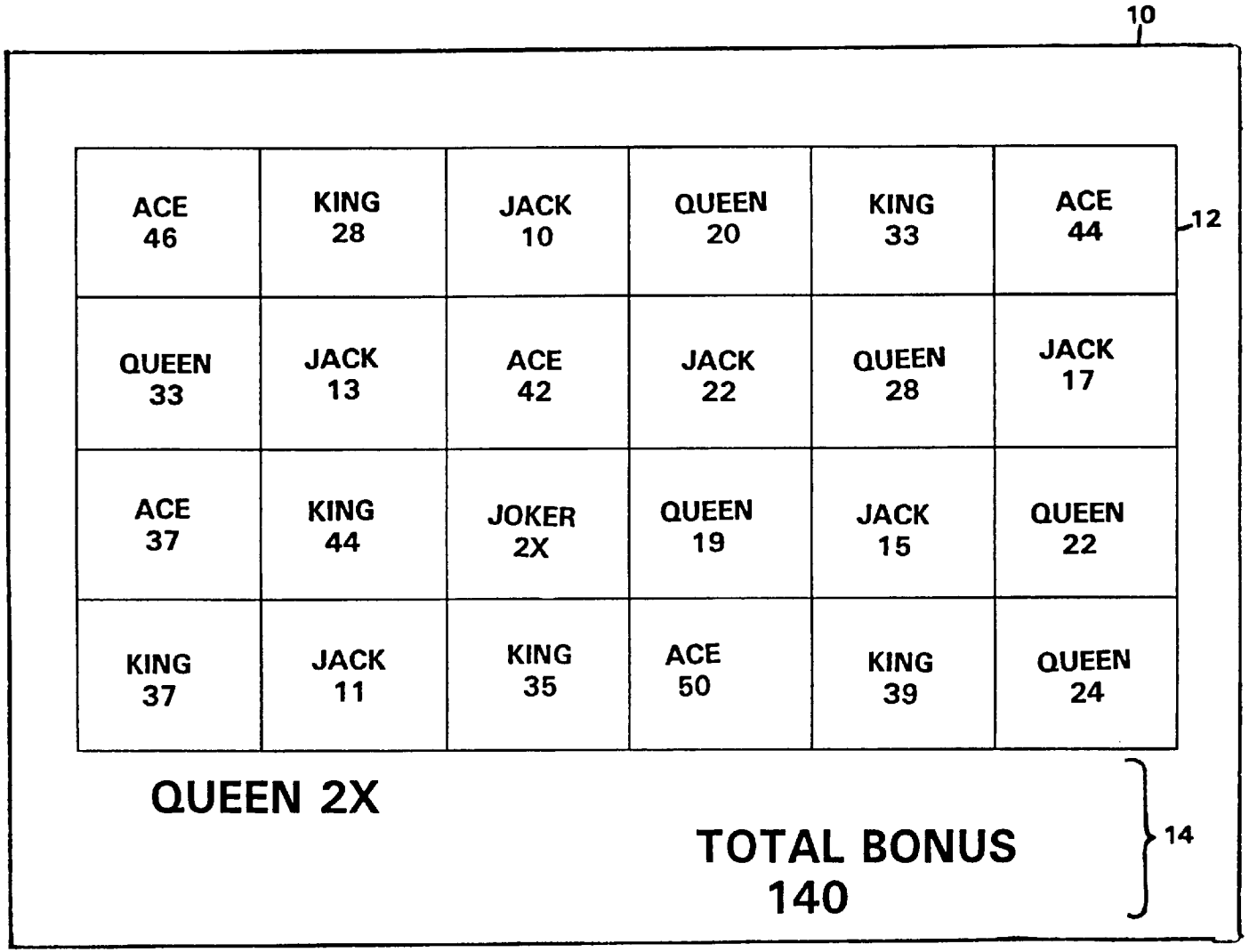

In FIG. 1, steps 3*a* to 6*a,* and FIGS. 8 and 9, the operation of the game as it relates to the bonus multiplier are described and shown. In the illustrative embodiment, a single bonus multiplier is shown but the game could include a plurality of bonus multipliers. And, in alternative embodiments, the bonus multiplier could have to earned by the player selecting two or more matching images associated with a bonus multiplier. As shown in FIGS. 8 and 9, the status area 14 includes the bonus multiplier indicator "2×" in instances where a bonus multiplier is selected.

In the illustrative embodiment of FIGS. 8 and 9 with a bonus multiplier selected, the award provided to the player would be 140 which is calculated by taking the sum of the awards associated with the three matching "QUEEN" images and multiplying by the bonus multiplier associated with the "JOKER" image ((20+28+22)×2=140).

In the preferred embodiments, there is a player recognizable hierarchy to the awards associated with the images. FIG. 10 sets forth the awards associated with each of the images from which the controller could randomly choose and assign images and awards to the player-selectable areas. In this illustrative embodiment, the awards associated with the "ACE" have a range of 35–55, the awards associated with the "KING" have a range of 28–44, the awards associated with the "QUEEN" have a range of 17–33 and the awards associated with the "JACK" have a range of 7–22. In assigning the images and awards, the controller assigns an equal number of each distinct image, except that one fewer of the highest ranking images is replaced with the bonus multiplier and its associated image. In the illustrative embodiment, six "KING", "QUEEN", and "JACK" images and an associated award would be assigned, five "ACE" images and their associated awards would be assigned, and one "JOKER" image and its associated bonus multiplier award would be assigned.

Although certain illustrative embodiments and alternatives have been shown and described, it is to be understood that various modifications and substitutions may be made by those skilled in the art without departing from the novel spirit and scope of the present invention.

What is claimed is:

1. A method of gaming, comprising:

providing a display divided into a plurality of player-selectable areas;

assigning a plurality of first matchable images to said display, each of said first matchable images being assigned to a respective one of a first plurality of said player-selectable areas, each of said first matchable images looking alike;

assigning a plurality of second matchable images to said display, each of said second matchable images being assigned to a respective one of a second plurality of said player-selectable areas, each of said second matchable images looking alike, each of said second plurality of said player-selectable areas being different than each of said first plurality of player-selectable areas;

assigning a plurality of award images to said player-selectable areas, each of said award images being assigned to one of said player-selectable areas, said first and second matchable images and said award images being assigned so that each of said plurality of player-selectable areas has one of said first and second matchable images and one of said award images associated therewith and so that said first and second matchable images and said award images are not visible prior to selection by a player of said player-selectable areas;

revealing a first one of said matchable images to the player in response to the player selecting said player-selectable area associated with said first one of said matchable images;

revealing a second one of said matchable images to the player in response to the player selecting said player-selectable area associated with said second one of said matchable images;

continuing to reveal matchable images to the player in response to the player selecting player-selectable areas associated with said matchable images; and if at least three matchable images revealed in response to the player selecting said player-selectable areas look alike, determining an award amount to be awarded to the player based upon said award images associated with said at least three matchable images.

2. A method of gaming as defined in claim 1 comprising assigning to said player-selectable areas a plurality of matchable images each of which represents an image of a portion of a playing card.

3. A method of gaming as defined in claim 1 comprising determining said award amount by adding together a plurality of award amounts indicated by said award images associated with said at least three matchable images.

4. A method of gaming as defined in claim 1 comprising assigning to each of said first matchable images an award amount falling within a first numeric range and assigning to each of said second matchable images an award amount falling within a second numeric range different than said first numeric range.

5. A method of gaming, comprising:

providing a display divided into a plurality of player-selectable areas;

assigning a plurality of first matchable images to said display, each of said first matchable images being assigned to a respective one of a first plurality of said player-selectable areas, each of said first matchable images looking alike;

assigning a plurality of second matchable images to said display, each of said second matchable images being assigned to a respective one of a second plurality of said player-selectable areas, each of said second matchable images looking alike, each of said second plurality of said player-selectable areas being different than each of said first plurality of player-selectable areas;

assigning a plurality of award images to said player-selectable areas, each of said award images being assigned to one of said player-selectable areas, said first and second matchable images and said award images being assigned so that each of said plurality of player-selectable areas has one of said first and second matchable images and one of said award images associated therewith and so that said first and second matchable images and said award images are not visible prior to selection by a player of said player-selectable areas;

revealing a first one of said matchable images to the player in response to the player selecting said player-selectable area associated with said first one of said matchable images;

revealing a second one of said matchable images to the player in response to the player selecting said player-selectable area associated with said second one of said matchable images;

continuing to reveal matchable images to the player in response to the player selecting player-selectable areas associated with said matchable images; and if at least two matchable images revealed in response to the player selecting said player-selectable areas look alike, determining an award amount to be awarded to the player based upon said award images associated with said at least two matchable images.

6. A method of gaming as defined in claim 5 comprising assigning to said player-selectable areas a plurality of matchable images each of which represents an image of a portion of a playing card.

7. A method of gaming as defined in claim 5 comprising determining said award amount by adding together a plurality of award amounts indicated by said award images associated with said at least two matchable images.

8. A method of gaming as defined in claim 5 comprising assigning to each of said first matchable images an award amount falling within a first numeric range and assigning to each of said second matchable images an award amount falling within a second numeric range different than said first numeric range.

9. A computer-controlled slot machine, comprising:

a plurality of slot machine reels;

a visual display; and a controller operatively coupled to said display and said slot machine reels, said controller allowing a player to play a bonus award game in response to a particular combination of symbols being displayed on said slot machine reels, said controller causing said display to be divided into a plurality of player-selectable areas;

said controller assigning a plurality of first matchable images to said display, each of said first matchable images being assigned to a respective one of a first plurality of said player-selectable areas, each of said first matchable images looking alike;

said controller assigning a plurality of second matchable images to said display, each of said second matchable images being assigned to a respective one of a second plurality of said player-selectable areas, each of said second matchable images looking alike, each of said second plurality of said player-selectable areas being different than each of said first plurality of player-selectable areas;

said controller assigning a plurality of award images to said player-selectable areas, each of said award images being assigned to one of said player-selectable areas, said first and second matchable images and said award images being assigned so that each of said plurality of player-selectable areas has one of said first second matchable images and one of said award images associated therewith and so that said first and second matchable images and said award images are not visible prior to selection by a player of said player-selectable areas;

said controller causing a first one of said matchable images to be revealed to the player in response to the player selecting said player-selectable area associated with said first one of said matchable images;

said controller causing a second one of said matchable images to be revealed to the player in response to the player selecting said player-selectable area associated with said second one of said matchable images;

said controller continuing to cause matchable images to be revealed to the player in response to the player selecting player-selectable areas associated with said matchable images; and IF at least two matchable images revealed in response to the player selecting said player-selectable areas look alike, said controller determining an award amount to be awarded to the player based upon said award images associated with said at least two matchable images.

10. A slot machine as defined in claim 9 wherein said controller assigns to said player-selectable areas a plurality of matchable images each of which represents an image of a portion of a playing card.

11. A slot machine as defined in claim 9 wherein said controller determines said award amount by adding together a plurality of award amounts indicated by said award images associated with said at least two matchable images.

12. A slot machine as defined in claim 9 wherein said controller assigns to each of said first matchable images an award amount falling within a first numeric range and assigning to each of said second matchable images an award amount falling within a second numeric range different than said first numeric range.

13. A computer-controlled gaming machine, comprising:

a visual display; and a controller operatively coupled to said display, said controller causing said display to be divided into a plurality of player selectable areas;

said controller assigning a plurality of first matchable images to said display, each of said first matchable images being assigned to a respective one of a first plurality of said player-selectable areas, each of said first matchable images looking alike;

said controller assigning a plurality of second matchable images to said display, each of said second matchable images being assigned to a respective one of a second plurality of said player-selectable areas, each of said second matchable images looking alike, each of said second plurality of said player-selectable areas being different than each of said first plurality of player-selectable areas;

said controller assigning a plurality of award images to said player-selectable areas, each of said award images being assigned to one of said player-selectable areas, said first and second matchable images and said award images being assigned so that each of said plurality of player-selectable areas has one of said first and second matchable images and one of said award images associated therewith and so that said first and second matchable images and said award images are not visible prior to selection by a player of said player-selectable areas;

said controller causing a first one of said matchable images to be revealed to the player in response to the player selecting said player-selectable area associated with said first one of said matchable images;

said controller causing a second one of said matchable images to be revealed to-the player in response to the player selecting said player-selectable area associated with said second one of said matchable images;

said controller continuing to cause matchable images to be revealed to the player in response to the player selecting player-selectable areas associated with said matchable images; and if at least two matchable images revealed in response to the player selecting said player-selectable areas look alike, said controller determining an award amount to be awarded to the player based upon said award images associated with said at least two matchable images.

14. A gaming machine as defined in claim 13 wherein said controller assigns to said player-selectable areas a plurality of matchable images each of which represents an image of a portion of a playing card.

15. A gaming machine as defined in claim 13 wherein said controller determines said award amount by adding together a plurality of award amounts indicated by said award images associated with said at least two matchable images.

16. A gaming machine as defined in claim 13 wherein said controller assigns to each of said first matchable images an award amount falling within a first numeric range and assigning to each of said second matchable images an award amount falling within a second numeric range different than said first numeric range.

* * * * *